US007664424B2

(12) United States Patent
Suganuma et al.

(10) Patent No.: US 7,664,424 B2
(45) Date of Patent: Feb. 16, 2010

(54) CLEANING DEVICE AND IMAGE FORMING APPARATUS

(75) Inventors: Toshihiro Suganuma, Tokyo (JP); Yusuke Kitagawa, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 414 days.

(21) Appl. No.: 11/505,404

(22) Filed: Aug. 17, 2006

(65) Prior Publication Data

US 2007/0172251 A1 Jul. 26, 2007

(30) Foreign Application Priority Data

Jan. 25, 2006 (JP) ..... 2006-016347

(51) Int. Cl.
*G03G 15/02* (2006.01)

(52) U.S. Cl. ..... 399/100; 399/357

(58) Field of Classification Search ..... 399/98–100, 399/357

See application file for complete search history.

(56) References Cited

U.S. PATENT DOCUMENTS 4,613,229 A * 9/1986 Miyake et al. ..... 399/357
5,659,853 A * 8/1997 Matsuda et al. ..... 399/176
6,088,551 A 7/2000 Satoh et al. ..... 399/100
6,374,071 B1 * 4/2002 Sato ..... 399/174
7,529,498 B2 * 5/2009 Kitagawa et al. ..... 399/100
2005/0163527 A1 7/2005 Tombs ..... 399/98

FOREIGN PATENT DOCUMENTS

| | | | |
|---|---|---|---|
| CN | 1148611 | C | 5/2004 |
| JP | 02-301779 | A | 12/1990 |
| JP | A-05-297690 | | 11/1993 |
| JP | 10-298316 | | 11/1998 |
| JP | 2005-257966 | | 9/2005 |
| KR | 1998-016573 | | 6/1998 |
| KR | 1998-051634 | | 9/1998 |

* cited by examiner

*Primary Examiner*—David M Gray
*Assistant Examiner*—Geoffrey T Evans
(74) *Attorney, Agent, or Firm*—Morgan, Lewis & Bockius LLP

(57) ABSTRACT

A cleaning device includes a cleaning component that cleans the surface of a charging component that charges an image carrier that has a surface on which an electrostatic latent image is to be formed. The cleaning component is a hollow body that cleans the surface of the charging component while being rotated by rotation of the charging component.

11 Claims, 13 Drawing Sheets

CLEANING DEVICE AND IMAGE FORMING APPARATUS

BACKGROUND

1. Technical Field of the Invention

The present invention relates to a cleaning device that cleans the surface of a charging component that charges the surface of a photosensitive body, and to an image forming apparatus provided with this cleaning device.

2. Related Art

In some charging devices, toner, dust and the like stuck to the surface of a charging component are cleaned off by using a cleaning component.

SUMMARY

According to an aspect of the present invention, a cleaning device includes a cleaning component that cleans the surface of a charging component that charges an image carrier that has a surface on which an electrostatic latent image is to be formed. The cleaning component is a hollow body that cleans the surface of the charging component while being rotated by rotation of the charging component.

BRIEF DESCRIPTION OF THE DRAWINGS

Exemplary embodiments of the present invention will be described in detail based on the following drawings, wherein.

DETAILED DESCRIPTION

A first exemplary embodiment of an image forming apparatus, in which a cleaning device of the present invention is provided, will be explained based on FIGS. 1 to 3.

Figure 3:
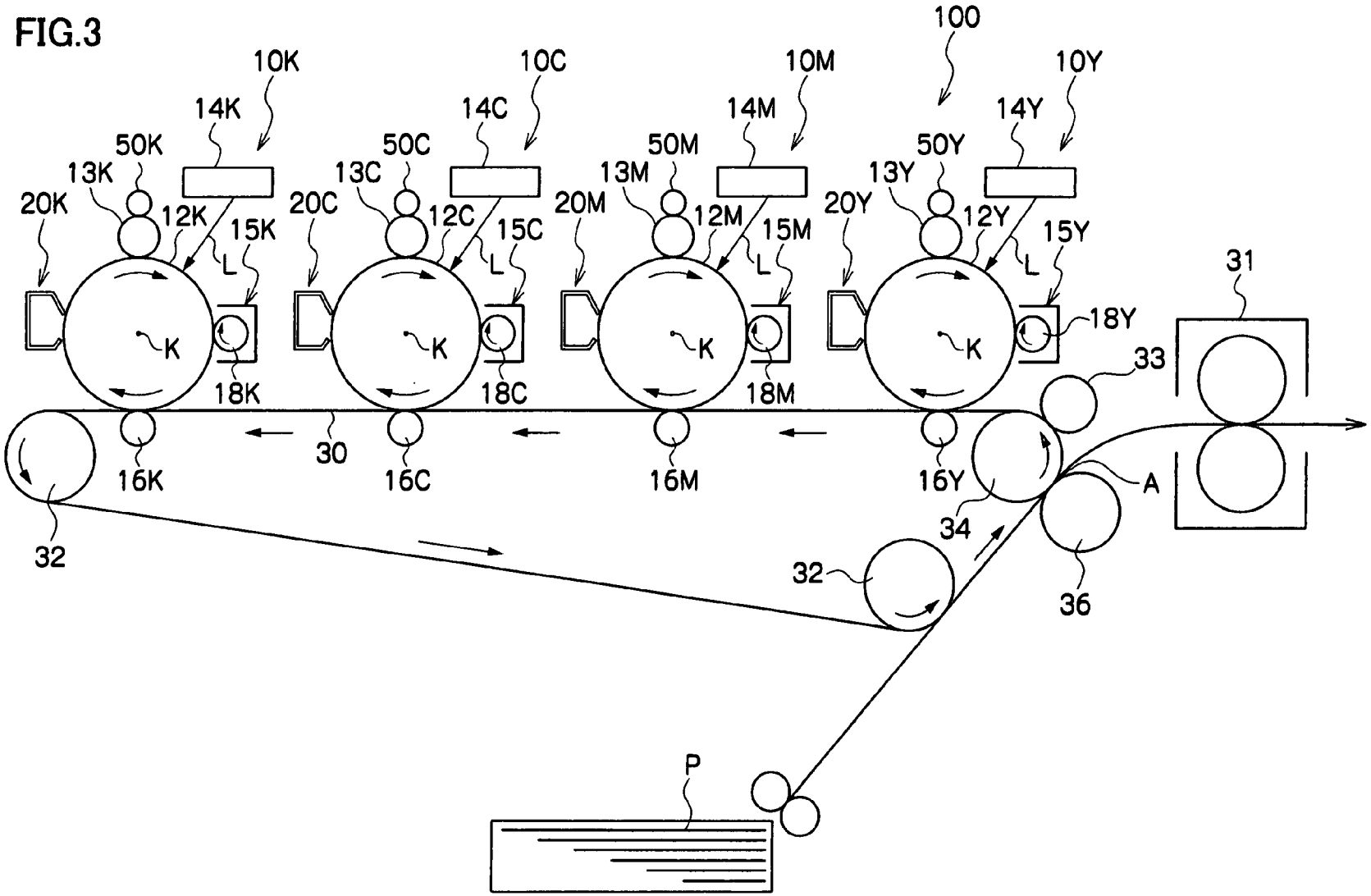
FIG. 3 is a structural outline drawing showing an image forming apparatus according to the first exemplary embodiment of the present invention.

The image forming apparatus 100 performs image processing based on color image data sent from an image data inputting device such as a personal computer, as shown in FIG. 3. This forms a color image with an electrophotographic system on a recording paper P that acts as the recording medium.

The image forming apparatus 100 is provided with image forming units 10Y, 10M, 10C, 10K that form toner images of each color yellow (Y), magenta (M), cyan (C) and black (K). Hereafter, when it is necessary to distinguish between YMCK in the explanations, one of Y, M, C or K will be attached behind the part number. When such distinction is not necessary, Y, M, C and K will be omitted.

The image forming units 10Y, 10M, 10C, 10K are arranged in a straight line in this order relative to the direction of progression of an endless intermediate transfer belt 30 that spans across due to a backup roll 34 and multiple spanning rolls 32. The intermediate transfer belt 30 is inserted between photosensitive bodies 12Y, 12M, 12C, 12K, which act as image carriers for each of the image forming units 10Y, 10M, 10C, 10K, and first transfer rolls 16Y, 16M, 16C, 16K, and these are arranged opposite each other, respectively.

Next, the image forming unit 10Y that forms a yellow toner image will be explained as a representative component, with regard to the configurations of each of the image forming units 10Y, 10M, 10C, 10K, and the operation of image formation will be explained.

The surface of the photosensitive body 12Y is uniformly charged with a charging roll 13Y that acts as a charging component. The charging roll 13Y rotates by the rotation of the photosensitive body 12Y The surface of the charging roll 13Y is cleaned with a hollow cleaning component 50Y that rotates by the rotation of the charging roll 13Y. The charging roll 13Y and the cleaning component 50Y will be described in detail later.

Next, image exposure corresponding to a yellow image is performed with an exposure device 14Y, and an electrostatic latent image corresponding to the yellow image is formed on the surface of the photosensitive body 12Y.

The electrostatic latent image corresponding to the yellow image is developed by toner supplied by a developing roll 18Y to which the developing bias of a developing device 15Y is applied. The yellow toner image is firstly transferred onto the intermediate transfer belt 30 with the press-contact force of the first transfer roll 16Y and the electrostatic attachment force caused by the transfer bias applied to the temporary transfer roll 16Y.

Not all the toner of the yellow image is perfectly transferred onto the intermediate transfer belt 30 with this first transfer, and a portion of the toner remains on the photosensitive body 12Y as transferred residual toner. Substances such as additive agents of the toner also stick to the surface of the photosensitive body 12Y The photosensitive body 12Y (after first transfer) passes through a position facing a cleaning device 20Y, and residue such as the transferred residual toner on the surface of the photosensitive body 12Y is removed. After that, the surface of the photosensitive body 12Y is recharged with the charging roll 13Y for the next image forming cycle.

Further, an image forming process similar to the one described above is performed with the image forming apparatus 100 at each of the image forming units 10Y, 10M, 10C, 10K at timing set in accordance with the relative position differences of each of the image forming units 10Y, 10M, 10C, 10K. Color toner images of each of Y, M, C and K are layered on the intermediate transfer belt 30 in this order, whereby a multilayer toner image is formed.

Then the recording paper P is conveyed at preset timing to a second transfer position A. The multilayer toner image is transferred all at once to the recording paper P from the intermediate transfer belt 30 with the electrostatic attachment force of a second transfer roll 36 to which transfer bias has been applied.

The recording paper P, on which the multilayer toner image has been transferred, is conveyed to a fixing device 31 after being separated from the intermediate transfer belt 30, and a full-color image is fixed to and formed on the recording paper P with heat and pressure.

The residual transferred toner on the intermediate transfer belt 30 that has not transferred onto the recording paper P is recovered with an intermediate transfer belt cleaner 33.

Next, the charging roll 13 and the cleaning component 50 will be explained in detail.

Figure 1:
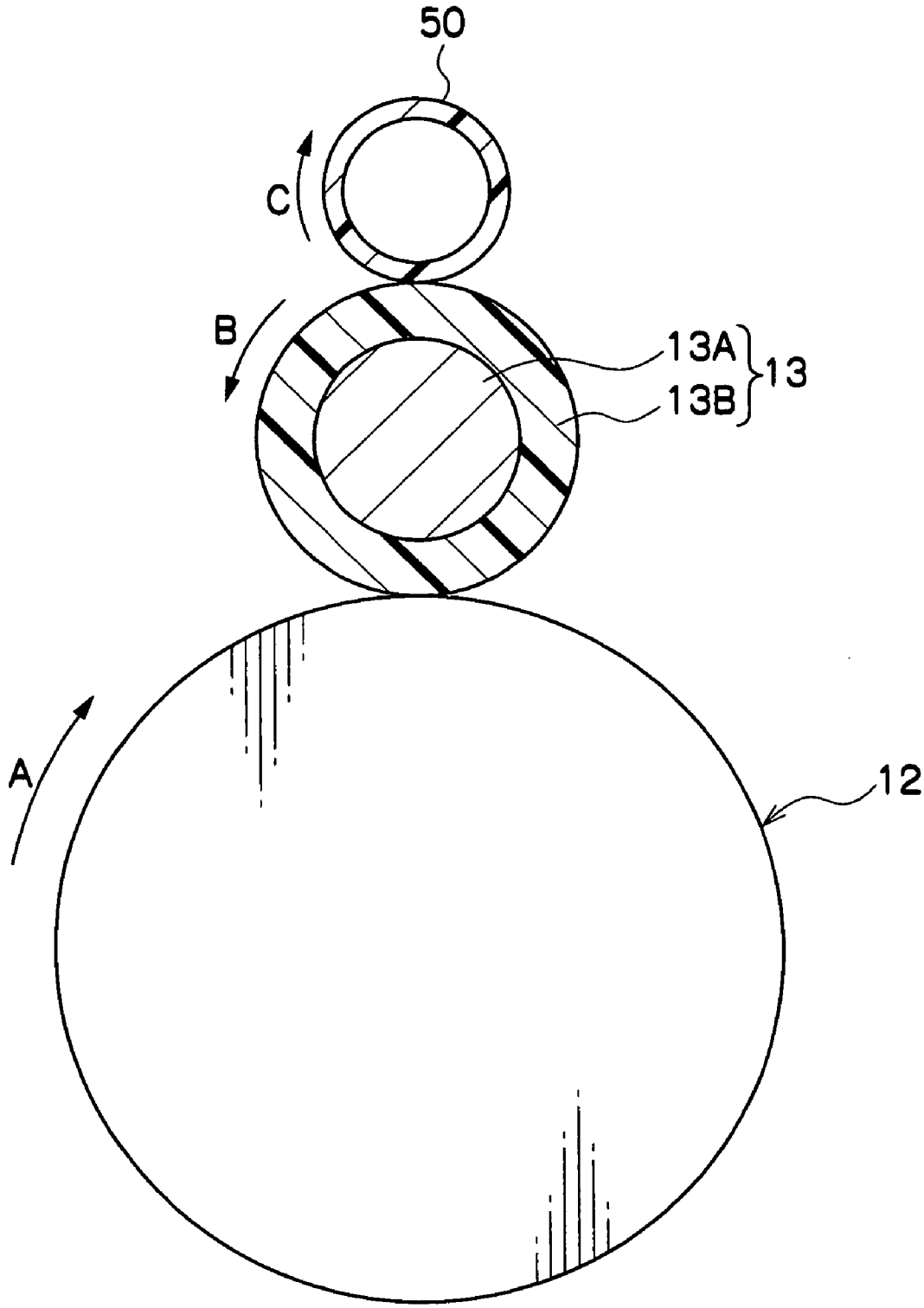
FIG. 1 is a cross-sectional drawing showing a photosensitive body, a charging roll, and a cleaning component according to a first exemplary embodiment of the present invention.
Figure 2:
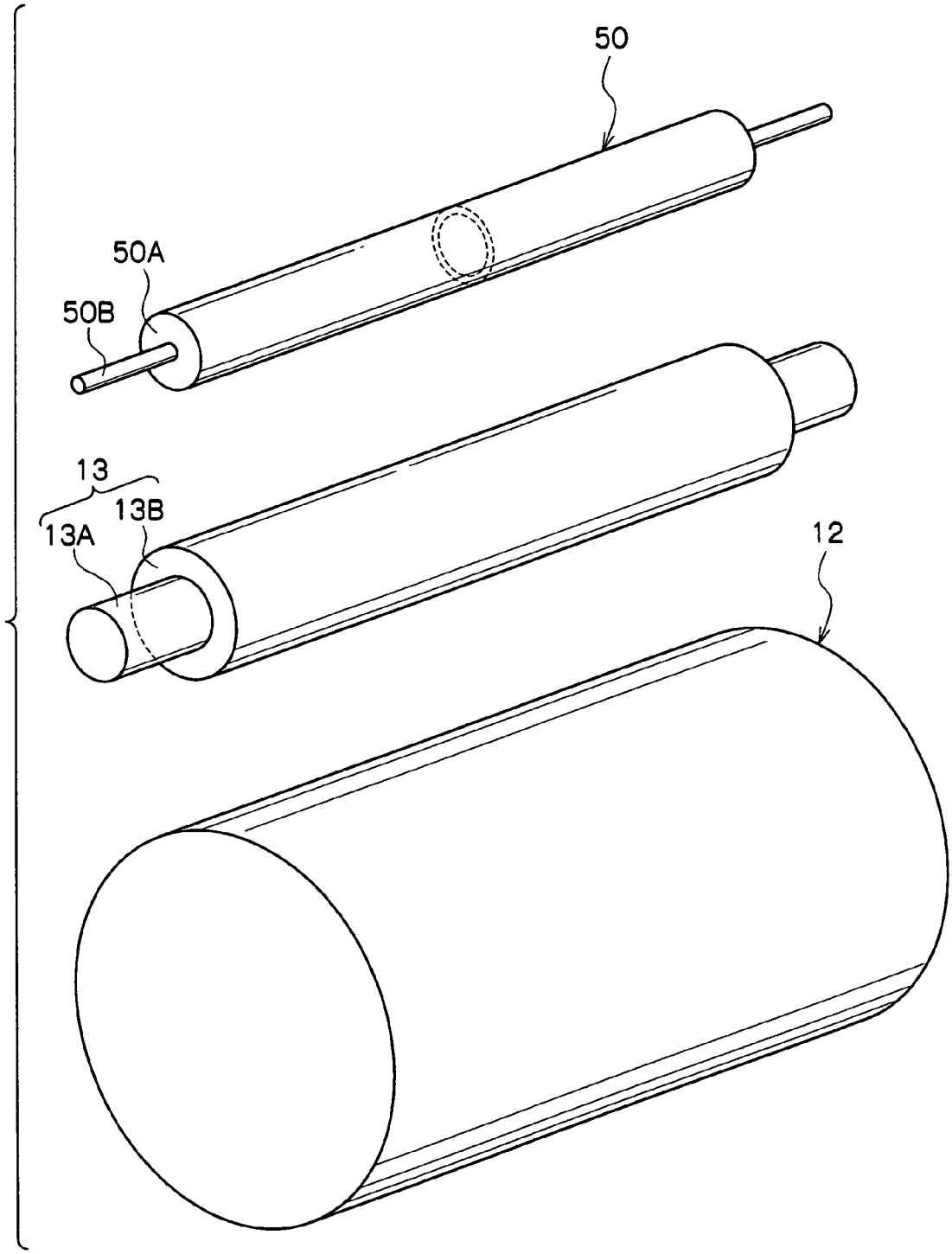
FIG. 2 is a perspective drawing showing the photosensitive body, charging roll, and cleaning component according to the first exemplary embodiment of the present invention.

As shown in FIGS. 1 and 2, the charging roll 13 and the cleaning component 50 are provided above the photosensitive body 12.

More specifically, the cylindrical charging roll 13 that comes into contact with the photosensitive body 12 is set at the upper portion of the photosensitive body 12. This charging roll 13 has a conductive shaft 13A around whose periphery a charging layer 13B is formed. Further, both ends of the shaft 13A are rotatably supported by the main body frame of the image forming apparatus 100.

The circular cleaning component 50 that comes into contact with the surface of the charging roll 13 and rotates by the rotation of the charging roll 13 is provided above the charging roll 13. Round caps 50A that seal the hollow portion of the cleaning component 50 are provided at both ends thereof. Rods 50B protrude from the central portions of these caps 50A, which are also rotatably supported by the main body frame of the image forming apparatus 100.

Due to this configuration, the charging roll 13 comes into contact with the surface of the photosensitive body 12 that rotates in the direction A shown in FIG. 1, and charges the surface of the photosensitive body while being rotated in the direction B shown in FIG. 1. Further, the cleaning component 50 comes into contact with the surface of this charging roll 13 and rotates in the direction C shown in FIG. 1 while being rotated by the rotation of the charging roll 13, and removes toner and dust and the like stuck to the surface of the charging roll 13.

In this configuration, the cleaning component 50 is made to be cylindrical (as a hollow body) whereby its diameter and rigidity can be increased while lightening the weight of the component.

Next, an image forming device of a second exemplary embodiment that employs a cleaning device of the present invention will be explained while referring to FIGS. 4 and 5.

Components in the second exemplary embodiment that are the same as in the first exemplary embodiment have been assigned the same numbers and explanations thereon have been omitted.

Unlike in the first exemplary embodiment, axial portions are not provided at both ends of the cleaning component. Rather, a case 62 that functions as a pressing component that presses a cleaning component 60 is provided.

Figure 5:
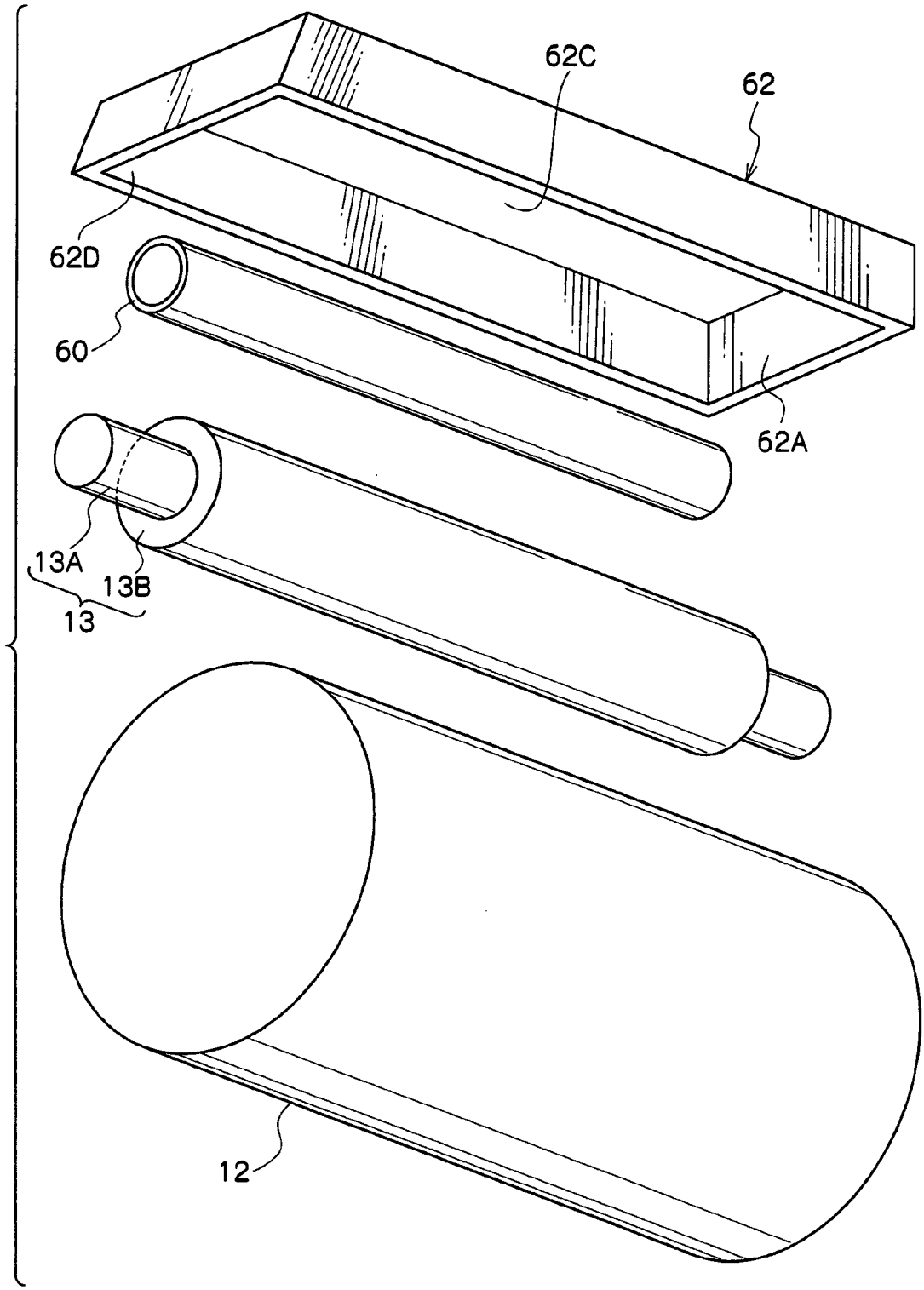
FIG. 5 is a perspective drawing showing the photosensitive body, charging roll, cleaning component, and case according to the second exemplary embodiment of the present invention.

More specifically, the cleaning component 60 is an elastic tube made from a hollow rubber body, as shown in FIG. 5, and both end portions are open rather than being sealed. Further, the case 62, which makes the cleaning component 60 press against the charging roll 13 and deform, is a rectangular box having a bottom area that is open and which elongates in the rotating axial direction of the charging roll 13. Side boards 62A of the case 62 come against the end portions of the cleaning component 60 and restrict movement in the axial direction of the charging roll 13 of the cleaning component 60.

Figure 4:
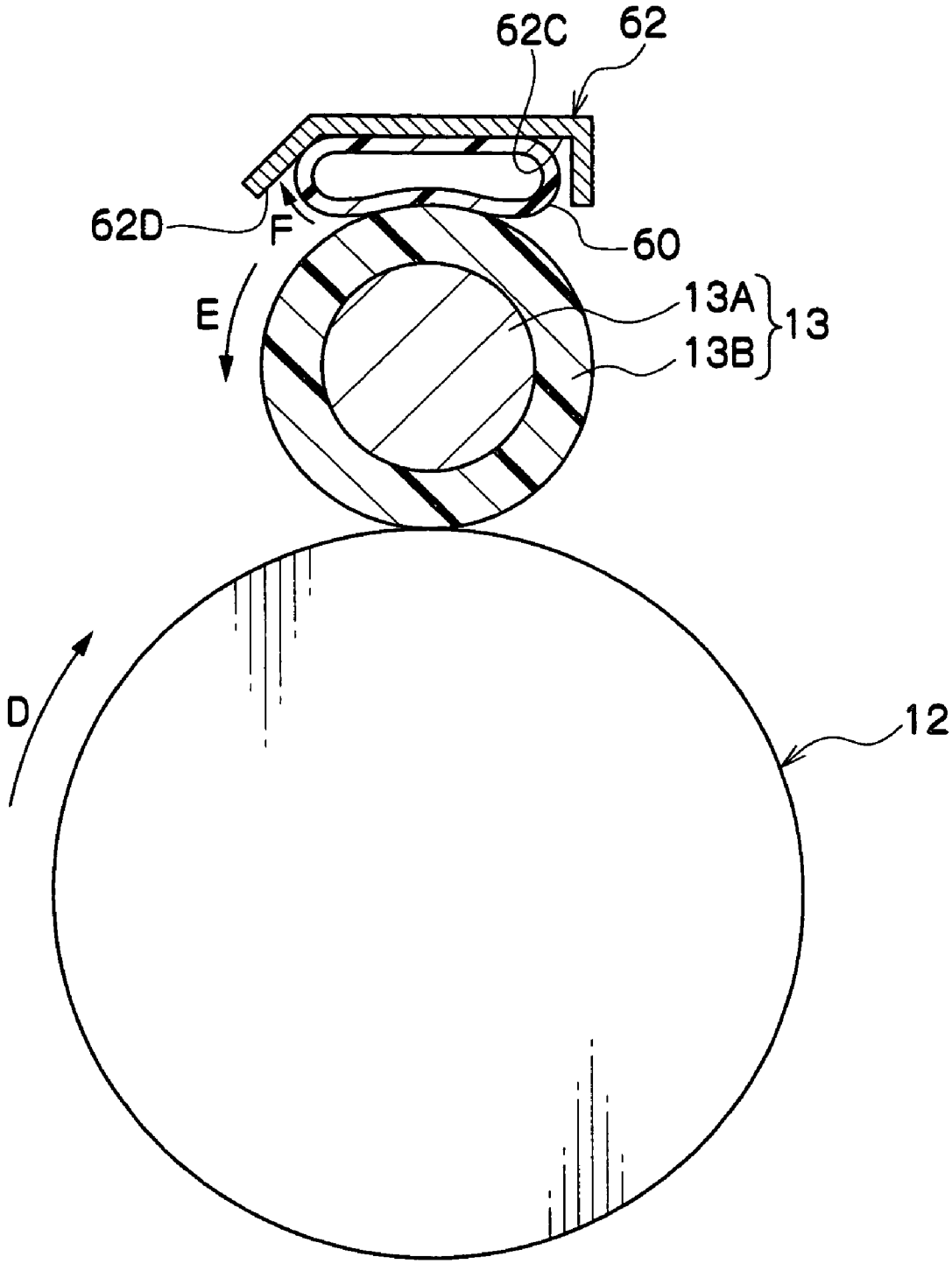
FIG. 4 is a cross-sectional drawing showing a photosensitive body, a charging roll, a cleaning component, and a case according to a second exemplary embodiment of the present invention.

As shown in FIG. 4, an upper panel 62C of the case 62 is attached to the main body frame so as to press the cleaning component 60 towards the charging roll 13 side. Due to this, the cleaning component 60 elastically deforms and the cross-sectional surface thereof becomes a constant elliptical shape. Further, a side board 62D that acts as a rotation position limiting component is provided so as to extend downwards at an angle. The side board 62D, which serves as a rotation position restricting component, follows along the axial direction of the charging roll 13 and restricts the rotation position of the cleaning component 60.

Since fluorine coating is performed on the surface of the case 62 that comes in contact with the cleaning component 60, the force of friction that acts between the cleaning component 60 and the case 62 is less than the force of friction that acts between the cleaning component 60 and the charging roll 13. As a result, the cleaning component 60 is rotated smoothly with the force of friction that acts between the cleaning component 60 and the charging roll 13.

Due to this configuration, the side board 62D comes into contact with the cleaning component 60 from the exterior side and thus restricts shift of a position of the cleaning component 60 in its rotating direction when it is rotated by the rotation of the charging roll 13. The elastically deformed cleaning component 60 is in contact with the upper panel 62C and side board 62D while being rotated by the rotation of the charging roll 13. While rotating in the F direction shown in FIG. 4, it cleans off toner and dust and the like adhered to the surface of the charging roll 13.

The cross-sectional surface of the cleaning component 60 is made to elastically deform into an elliptical shape, whereby a preset nip width is ensured along the axial direction between the cleaning component 60 and the charging roll 13. Accordingly, this improves the ability of the device to clean the surface of the charging roll 13.

Further, since the upper panel 62C of the case 62 and the side board 62D can be formed into an integrated body, a separate restricting component provided at another position is unnecessary.

It should be noted that although detailed explanations regarding specific exemplary embodiments of the present invention were given, the present invention is not limited to these exemplary embodiments. It is clear to those skilled in the art that a wide variety of embodiments that fall within the scope of the present invention are also possible. For example, in the above-described exemplary embodiments, an elastic tube made from a rubber material was used for the cleaning component 50, however, in place of this, an elastic tube made from a resin such as a polyimide or a polyethylene terephthalate can also be used.

Further, in the above exemplary embodiments, the force of friction between the case 62 and the cleaning component 60 is reduced by providing a fluorine coat on the case 62. However, components such as ribs can be provided on the surface of the case 62 that contacts the cleaning component 60, and friction can be reduced by avoiding contact with the surface of the cleaning component 60.

Next, a third exemplary embodiment of an image forming apparatus, in which a cleaning device of the present invention is provided, will be explained following FIGS. 6 and 7.

Components in this exemplary embodiment that are the same as in the second exemplary embodiment have been assigned the same numbers and explanations thereon have been omitted.

In this exemplary embodiment, the cleaning component 60 does not restrict the positional shift of the cleaning component 60 with a case from the exterior, as in the second exemplary embodiment. Rather, the positional shift of the cleaning component 60 is restricted with a rod 72 arranged in the interior thereof.

Figure 7:
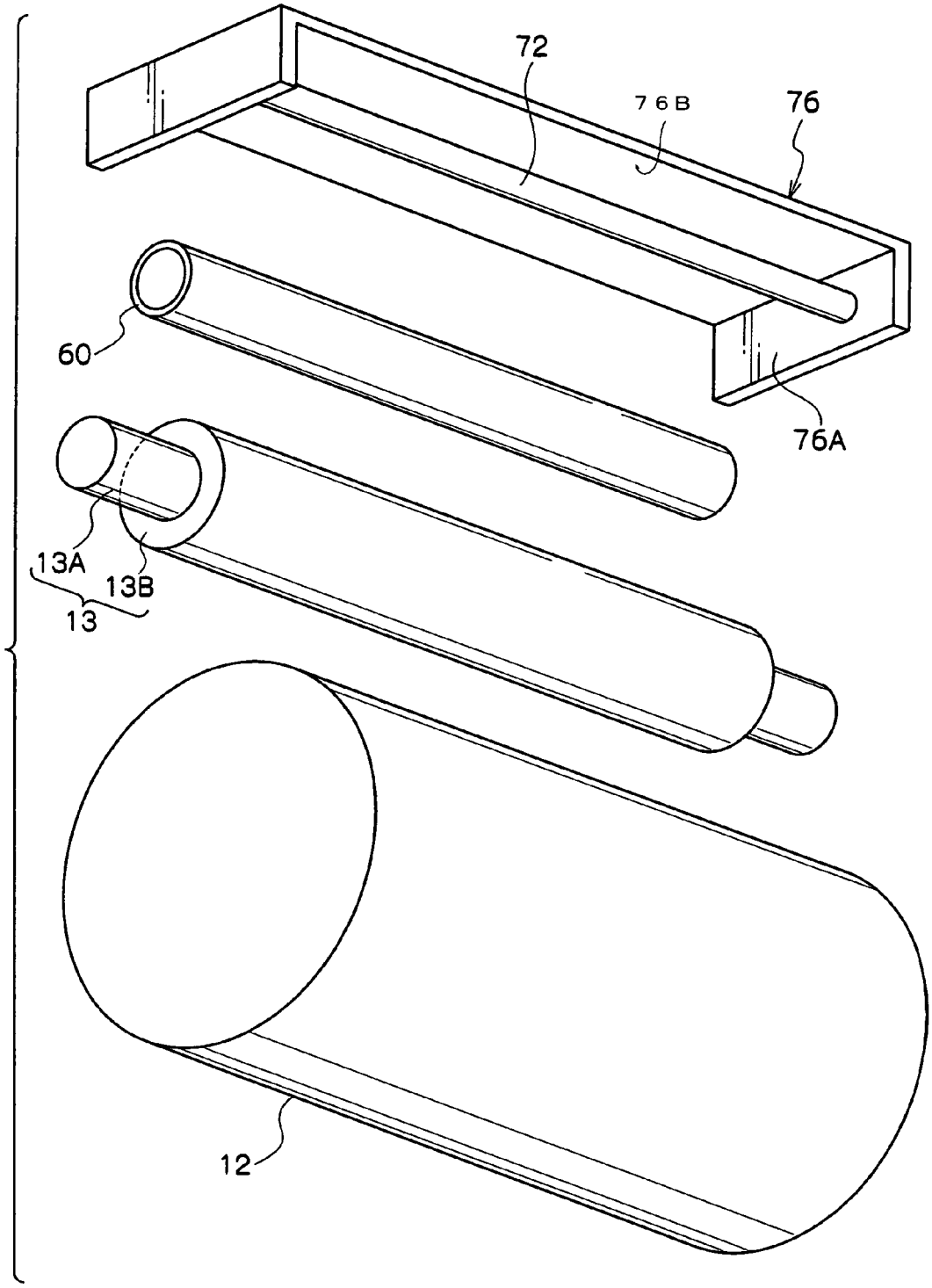
FIG. 7 is a perspective drawing showing the photosensitive body, charging roll, cleaning component, case, and shaft according to the third exemplary embodiment of the present invention.

More specifically, as shown in FIG. 7, side boards 76A of a channel 76 act as a pressing component and these have the cylindrical rod 72 set to span self-rotatably along the axial direction of the charging roll 13. This rod 72 is in contact with the inner peripheral surface of the cleaning component 60, and movement in the direction it is driven is restricted.

Further, since fluorine coating is performed on the surface 76B that comes in contact with the cleaning component of the channel 76 and insides of side boards 76A of the channel 76, the force of friction that acts between the cleaning component 60 and the channel 76 is less than the force of friction that acts between the cleaning component 60 and the charging roll 13. As a result, the cleaning component 60 is rotated smoothly with the force of friction that acts between the cleaning component 60 and the charging roll 13.

Figure 6:
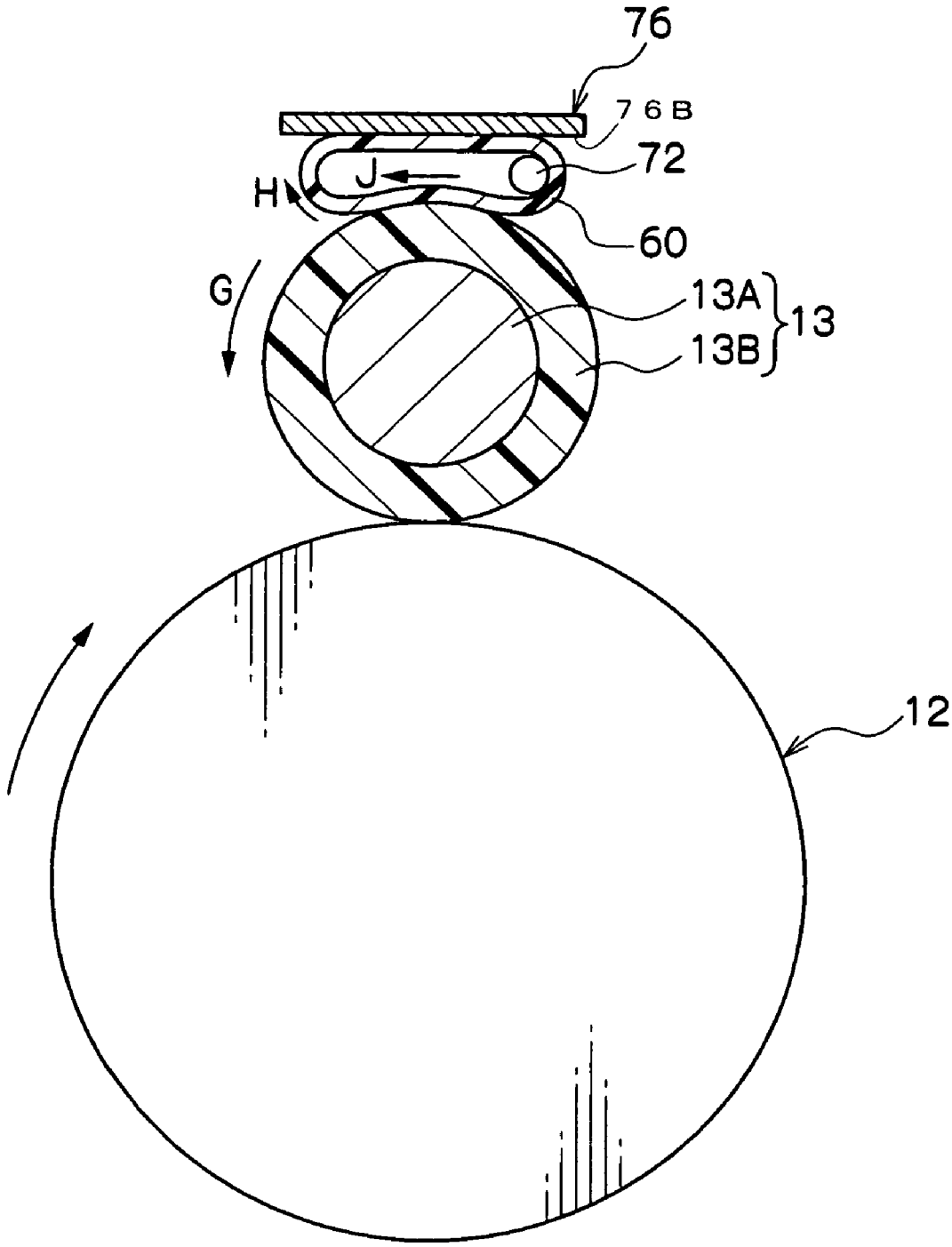
FIG. 6 is a cross-sectional drawing showing a photosensitive body, a charging roll, a cleaning component, a case, and a shaft according to a third exemplary embodiment of the present invention.

Due to this configuration, the rod 72 is inserted into the cleaning component 60 and comes into contact with the inner peripheral surface of the cleaning component 60, as shown in FIG. 6. The cleaning component 60 is rotated in direction H by the rotation of the charging roll 13 rotating in direction G It should be noted that with this exemplary embodiment, the cleaning component 60 rotates due to the force of friction with the charging roll 13, so force in the direction of the J arrow acts upon the cleaning component 60 at the portion that is in contact with the charging roll 13. Here, the rod 72 is arranged to the right side in the cleaning component 60 and restricts the rotation position of the cleaning component 60.

Accordingly, manufacturing costs can be reduced since the rotation position of the elastic tube is restricted with the rod 72, which is a multipurpose component.

Figure 8:
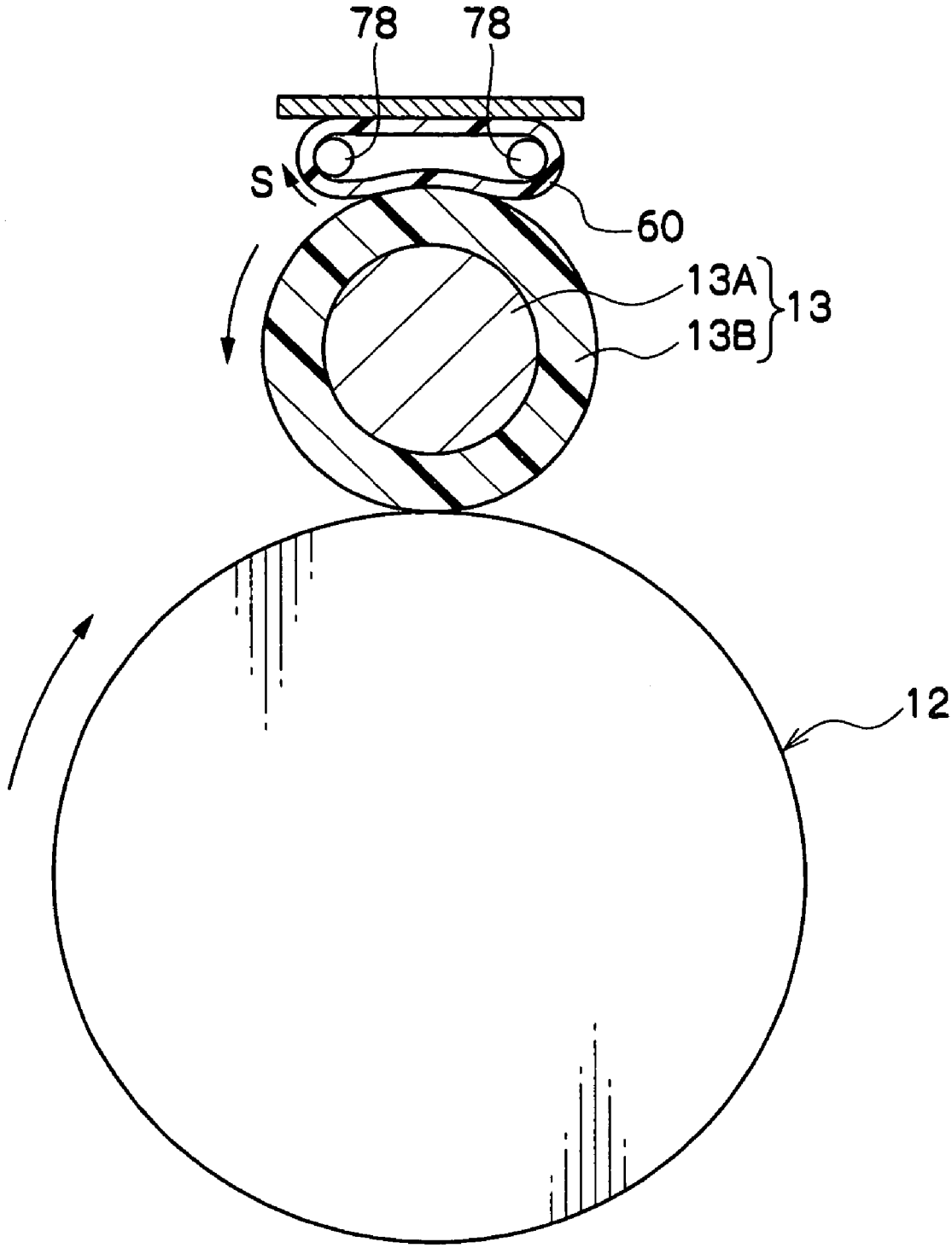
FIG. 8 is a cross-sectional drawing showing a photosensitive body, a charging roll, a cleaning component, a case, a first shaft, and a second shaft according to a fourth exemplary embodiment of the present invention.

Next, a fourth exemplary embodiment of the image forming apparatus, to which the cleaning device of the present invention is applied, will be explained based on FIG. 8.

Components in this exemplary embodiment that are the same as in the second exemplary embodiment have been assigned the same numbers and explanations thereon have been omitted.

With this exemplary embodiment, the cleaning component is not pressed upon from the exterior with a case as in the second exemplary embodiment. Rather, the cleaning component 60 is pressed and spread by a pair of shafts 78 inserted into the cleaning component 60, which is thus pressed onto the charging roll 13. Furthermore, this pair of shafts 78 is self-rotatably attached to the main body frame of the image forming apparatus 100 so that their axial directions face in the same direction as the axial direction of the charging roll 13.

Due to this configuration, a preset nip width along the axial direction between the elastically deformed cleaning component 60 and the charging roll 13 can be ensured. Further, the cleaning component 60 is securely rotated like a belt conveyer due to the rotations of the shafts 78. The cleaning capability of the device is thus made constant.

Next, a fifth exemplary embodiment of the image forming apparatus, to which the cleaning device of the present invention is applied, will be explained following FIGS. 9 to 11.

Components in this exemplary embodiment that are the same as in the first exemplary embodiment have been assigned the same numbers and explanations thereon have been omitted.

With this embodiment, unlike in the first exemplary embodiment, a cleaning component 80 is an elastic tube made from a hollow rubber material. A nip forming component 82 that presses the cleaning component 80 from the interior onto the charging roll 13 is provided. A preset nip width is formed between it and the charging roll 13 along the axial direction and further, a stable nip force is generated.

Figure 9:
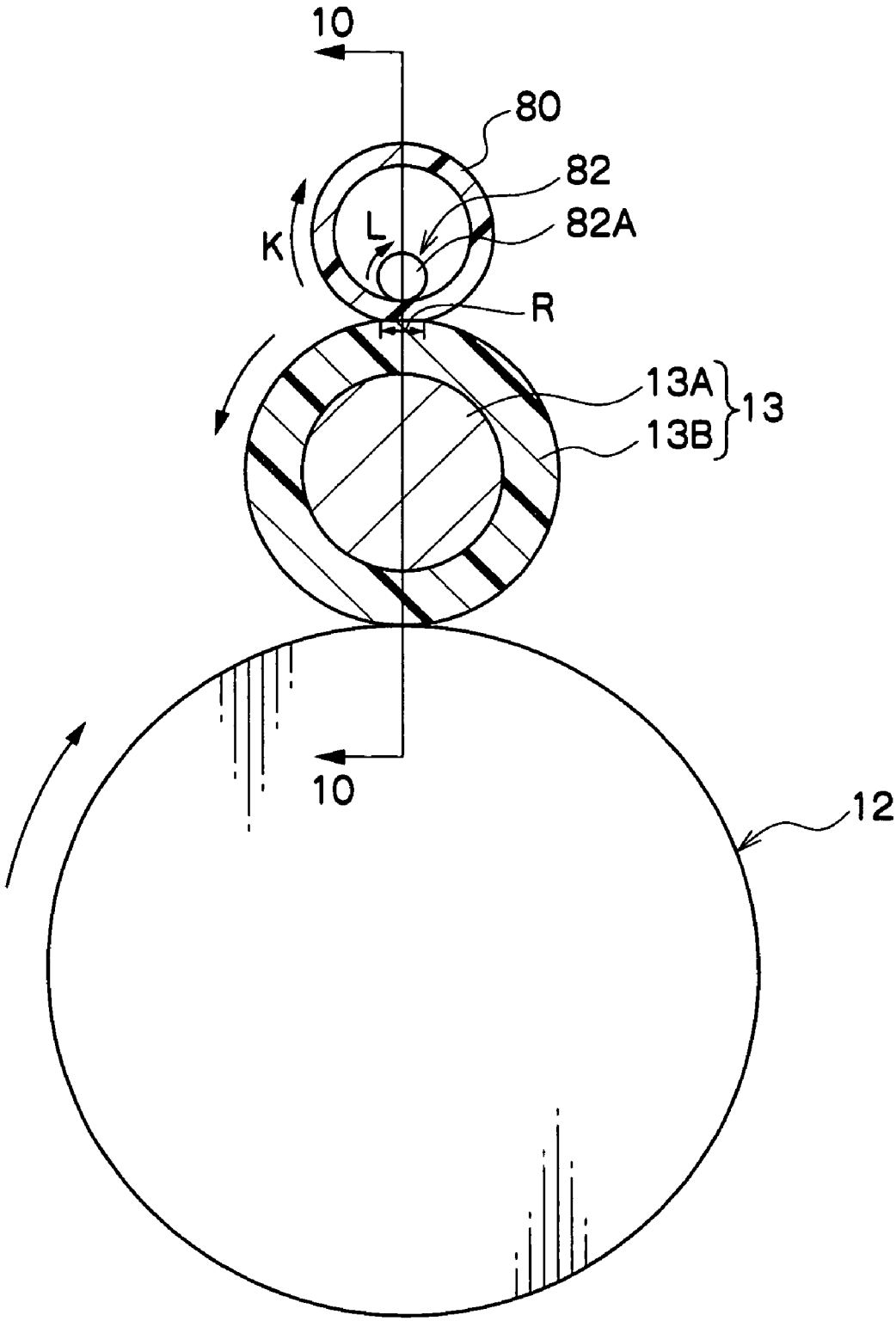
FIG. 9 is a cross-sectional drawing showing a photosensitive body, a charging roll, a cleaning component, and a nip forming component according to a fifth exemplary embodiment of the present invention.
Figure 10:
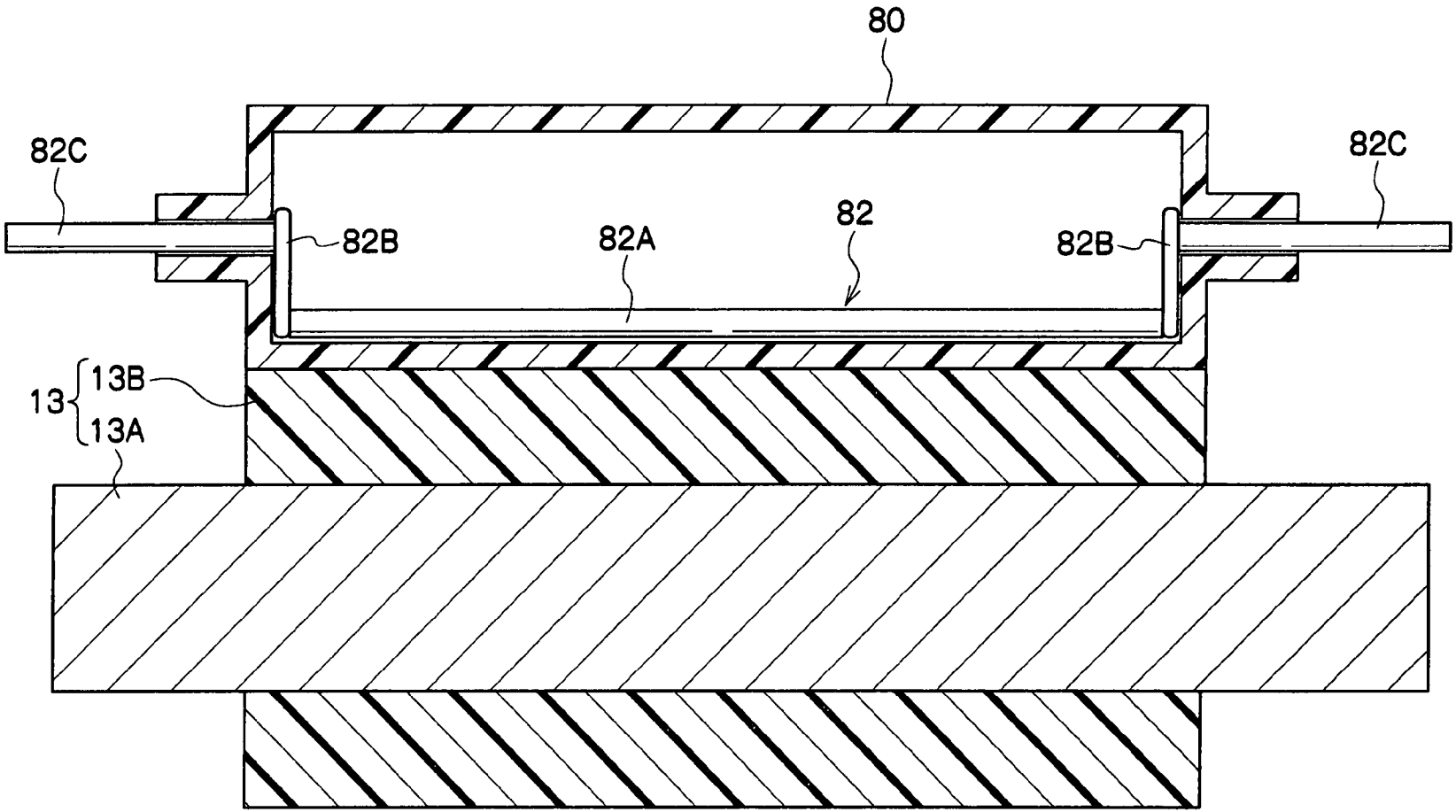
FIG. 10 is a cross-sectional drawing of the 10-10 shown in FIG. 9 and shows the charging roll, cleaning component, and nip forming component according to the fifth exemplary embodiment of the present invention.
Figure 11:
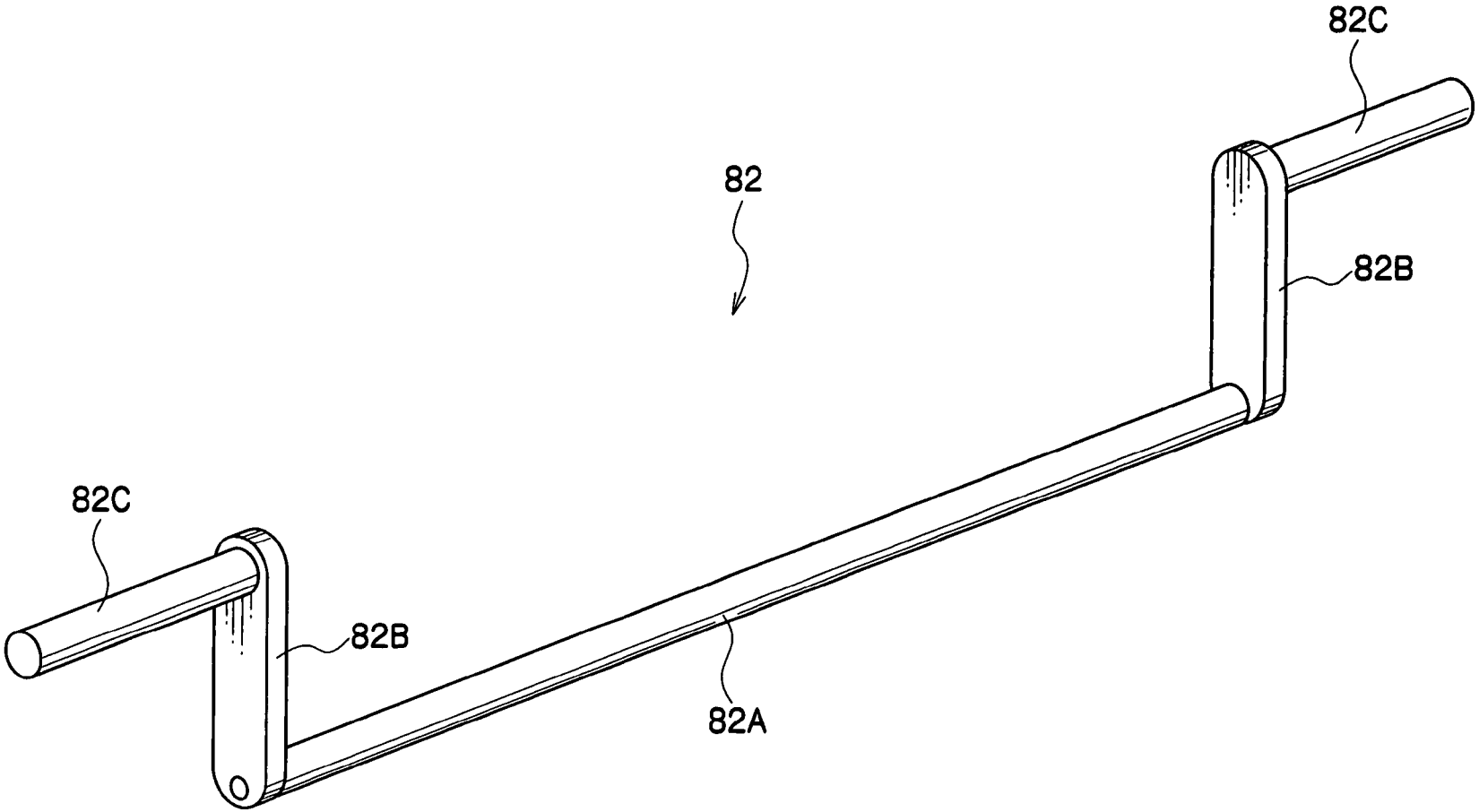
FIG. 11 is a perspective drawing showing the nip-forming component according to the fifth exemplary embodiment of the present invention.

More specifically, the nip forming component 82 that extends along the axial direction of rotation of the cleaning component 80 is provided in the interior thereof, as seen in FIG. 10. As shown in FIG. 11, the nip forming component 82 is provided with a cylindrical nip portion 82A that presses the cleaning component 80 against the charging roll 13; supports 82B that rotatably support both ends of the nip portion 82A; and cylindrical retainers 82C that are attached to the main body frame of the image forming apparatus 100 and which retain the supports 82B. Further, as shown in FIG. 9, the nip portion 82A presses the cleaning component 80 towards the charging roll 13 from inside the cleaning component 80, whereby the surface of the charging roll 13 deforms and the nip width between the charging roll 13 and the cleaning component 80 increases (see the range R shown in FIG. 9).

Further, fluorine coating is performed on the nip portion 82A so the force of friction that acts between the cleaning component 80 and nip forming component 82 is less than the force of friction that acts between the cleaning component 80 and charging roll 13.

Due to this configuration, the cleaning component 80 is driven with the charging roll 13 and toner and dust and the like stuck to the surface of the charging roll 13 can be scraped off with certainty while the cleaning component 80 rotates in the K direction shown in FIG. 9.

Next, a sixth exemplary embodiment of an image forming apparatus, to which a cleaning device of the present invention is applied, will be explained based on FIGS. 12 to 13.

Components in this exemplary embodiment that are the same as in the fifth exemplary embodiment have been assigned the same numbers and explanations thereon have been omitted.

Unlike in the fifth exemplary embodiment, the nip portion in this exemplary embodiment that presses the cleaning component 80 against the charging roll 13 is not cylindrical. Rather, the cleaning component 80 is a curved component that curves along the exterior surface of the charging roll 13.

Figure 12:
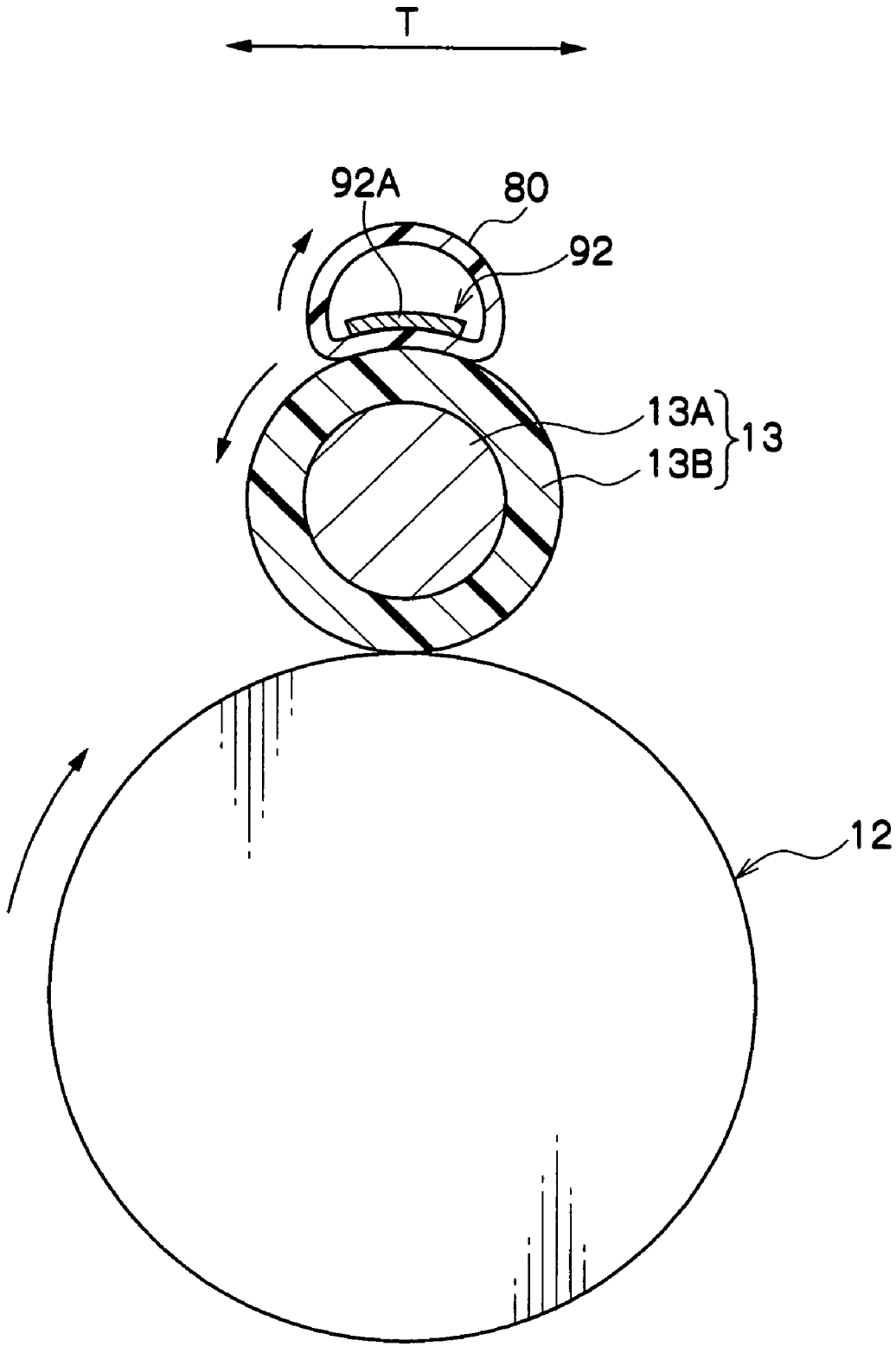
FIG. 12 is a cross-sectional drawing showing a photosensitive body, a charging roll, a cleaning component, and a nip forming component according to a sixth embodiment of the present invention.
Figure 13:
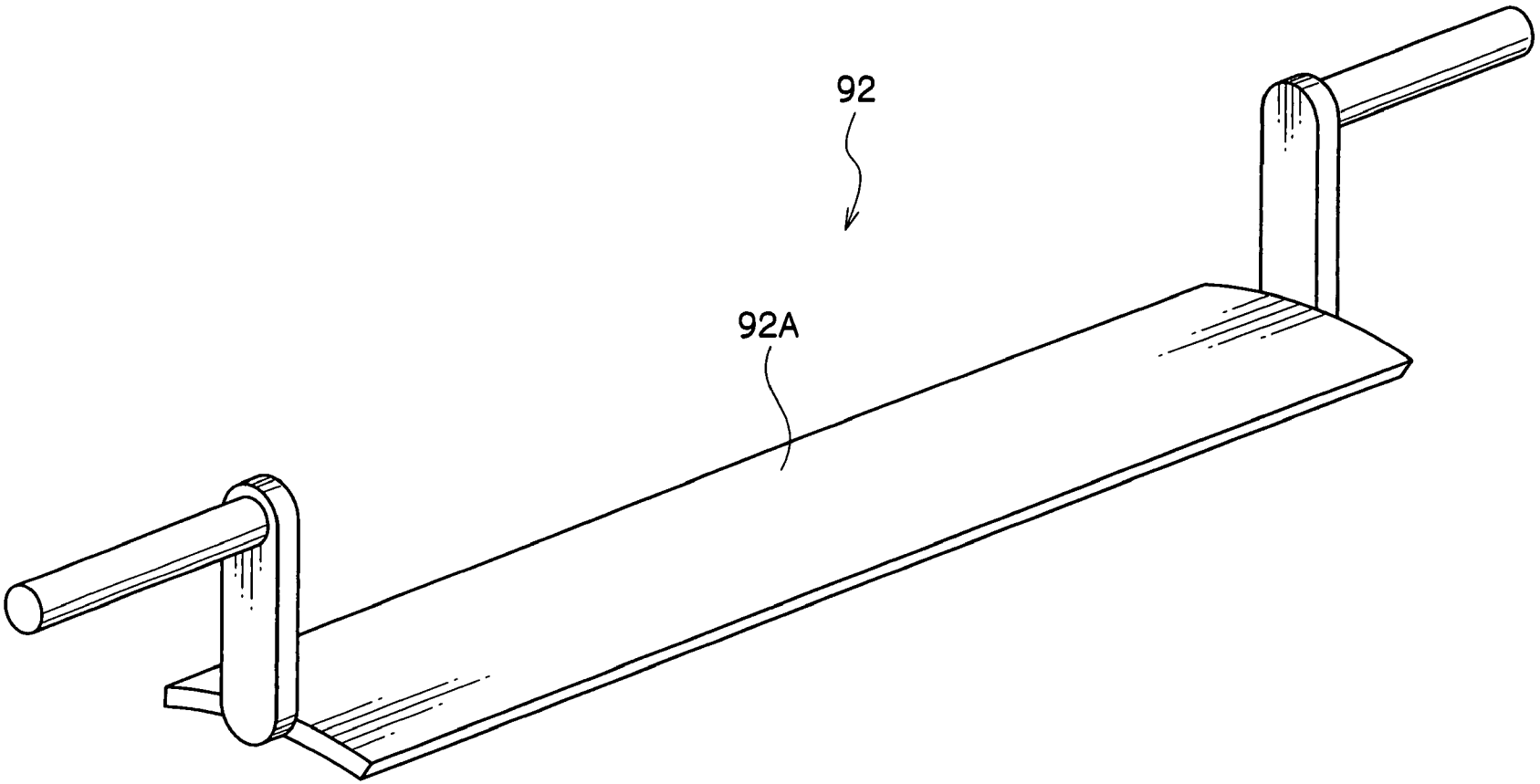
FIG. 13 is a perspective drawing showing the nip-forming component according to the sixth embodiment of the present invention.

More specifically, as shown in FIG. 13, the shape of a nip portion 92A of a nip forming component 92 is a curved board that extends in the axial direction of the charging roll 13 (see FIG. 12). As shown in FIG. 12, the curved surface of the nip portion 92A presses the cleaning component 80 against the charging roll 13 from the interior of the cleaning component

80. For this reason, the nip width between the outer surface of the cleaning component 80 and the outer surface of the charging roll 13 increases.

Further, the nip width can be adjusted by adjusting the length of the peripheral direction of the charging roll 13 of the nip portion 92A without placing stress on the charging roll 13. Accordingly, the endurance of the cleaning component 80 is improved and changing of the nip width is simplified.

Furthermore, the curvature of the cleaning component 80 changes sharply and an edge portion is formed at both ends (i.e., before and behind the nip region) of the widthwise direction of the nip portion 92A (i.e., the direction indicated with the T arrow in FIG. 12). With these edge portions, the cutting power that scrapes off toner and dust and the like stuck to the charging roll 13 increases and the cleaning capability improves.

What is claimed is:

1. A cleaning device comprising:

a cleaning component that cleans the surface of a charging component that charges an image carrier that has a surface on which an electrostatic latent image is to be formed, wherein the cleaning component being a hollow body, disposed having a substantially empty space therein, that cleans the surface of the charging component while being rotated by rotation of the charging component, and the cleaning component further comprising:

a pressing component that presses and deforms the elastic tube against the charging component; and a rotation position restricting component that restricts the rotation position of the elastic tube when the elastic tube is rotated by the rotation of the charging component, wherein the pressing component and the rotation position restricting component are in contact with the external peripheral surface of the elastic tube, and wherein the rotation position restricting component restricts movement of the elastic tube in the direction of driving.

2. The cleaning device of claim 1, wherein the rotation position restricting component is a material that extends outwardly from the end portion of the pressing component.

3. The cleaning device of claim 1, wherein the rotation position restricting component is a rotatable rod inserted into the elastic tube, and the rotation position restricting component contacts the inner peripheral surface of the elastic tube and restricts movement of the elastic tube in the driving direction.

4. The cleaning device of claim 1, wherein the force of friction between the elastic tube and the pressing component is less than the force of friction between the elastic tube and the charging component.

5. A cleaning device comprising:

a cleaning component that cleans the surface of a charging component that charges an image carrier that has a surface on which an electrostatic latent image is to be formed, wherein the cleaning component comprises:

a hollow body being an elastic tube, disposed having a substantially empty space therein, that cleans the surface of the charging component while being rotated by rotation of the charging component; and a pair of rotatable shafts that are inserted into the elastic tube to deform and press the elastic tube from the interior side thereof against the charging component.

6. A cleaning device comprising:

a cleaning component that cleans a surface of a charging component that charges an image carrier that has a surface on which an electrostatic latent image is to be formed, and the cleaning component comprises:

an elastic tube, disposed having a substantially empty space therein, that cleans the surface of the charging component while being rotated by rotation of the charging component; and a nip-forming component that is inserted into the elastic tube to press the elastic tube from the inner side thereof against the charging component, and forms a preset nip width with the charging component.

7. The cleaning device of claim 6, wherein the elastic tube is pressed to the charging component by the nip forming component, and a nip width is increased due to deformation of the surface of the charging component.

8. The cleaning device of claim 6, wherein the nip-forming unit is a curved board that curves along the surface of the charging component.

9. The cleaning device of claim 6, wherein the force of friction between the elastic tube and the nip forming component is less than the force of friction between the elastic tube and the charging component.

10. An image forming apparatus comprising:

a cleaning device, wherein the cleaning device comprises:

a cleaning component that cleans the surface of a charging component that charges an image carrier that has a surface, on which an electrostatic latent image is to be formed, and the cleaning component is a hollow body, disposed having a substantially empty space therein, that cleans the surface of the charging component while being rotated by rotation of the charging component; and further comprises:

a pressing component that presses and deforms the elastic tube against the charging component; and a rotation position restricting component that restricts the rotation position of the elastic tube when the elastic tube is rotated by the rotation of the charging component, wherein the pressing component and the rotation position restricting component are in contact with the external peripheral surface of the elastic tube, and wherein the rotation position restricting component restricts movement of the elastic tube in the direction of driving.

11. An image forming apparatus comprising:

a cleaning device, wherein the cleaning device comprises:

a cleaning component that cleans a surface of a charging component that charges an image carrier that has a surface, on which an electrostatic latent image is to be formed and, the cleaning component comprises:

an elastic tube, disposed having a substantially empty space therein, that cleans the surface of the charging component while being rotated by rotation of the charging component; and a nip forming component that is inserted into the elastic tube to press the elastic tube from the inner side thereof against the charging component, and forms a preset nip width with the charging component.

* * * * *